US005611482A

United States Patent [19]

Gaetano

[11] Patent Number: 5,611,482

[45] Date of Patent: Mar. 18, 1997

[54] CONTINUOUS FEED STORAGE ENVELOPES

[76] Inventor: Ralph R. Gaetano, 7033 Dumbarton Pl., Bethel Park, Pa. 15102

[21] Appl. No.: 247,578

[22] Filed: May 23, 1994

[51] Int. Cl.[6] ..... B65D 27/10

[52] U.S. Cl. ..... 229/69

[58] Field of Search ..... 229/69, 71, 67.1, 229/67.2, 67.3, 67.4, 72, 80.5, 87.5; 150/147; 383/35, 38, 39, 40, 41, 66, 106, 107, 119

[56] References Cited

U.S. PATENT DOCUMENTS

| | | | |
|---|---|---|---|
| 3,217,438 | 11/1965 | Hathaway | 229/71 X |
| 3,299,928 | 1/1967 | Inkley | 229/72 X |
| 3,593,913 | 7/1971 | Bremer | 229/72 X |
| 3,613,281 | 10/1971 | Lennartz | 383/119 X |
| 3,900,160 | 8/1975 | Goto et al. | 229/69 X |
| 4,073,118 | 2/1978 | Weber et al. . | |
| 4,115,981 | 9/1978 | Hell et al. . | |
| 4,139,978 | 2/1979 | Jensen et al. . | |
| 4,154,046 | 5/1979 | Weber et al. . | |
| 4,217,743 | 8/1980 | Escales et al. . | |
| 4,508,224 | 4/1985 | Weber et al. | 229/69 X |
| 4,927,071 | 5/1990 | Wood | 229/71 |
| 4,995,219 | 2/1991 | Hicks . | |
| 5,070,677 | 12/1991 | Hicks . | |

OTHER PUBLICATIONS

"Remove Negative Bagging Bottle Necks Through Automation" Hicks Equipment, Inc. 1990 No month.

*Primary Examiner*—Jes F. Pascua

*Attorney, Agent, or Firm*—Price & Adams

[57] ABSTRACT

A plurality of continuous feed storage envelopes are connected in a strip formed by a seal flap layer of glassine overlying a base layer of paper material. Connected envelopes are fed through a machine that cuts individual negative frames from a roll of developed film for insertion in the compartments of the envelopes. The envelopes are separated from one another in the series by tear lines. The lower edge of each envelope is sealed by a glue line. Extending transversely between the overlying layers are parallel spaced glue lines that form the lateral margins of each envelope. At one lateral margin the glue line extends the entire length of the envelope. At the opposite margin the glue line has a shortened length so that a portion of the overlying layers along one margin are not adhesively secured. When the envelopes are connected in the series, both lateral margins of each envelope remain sealed by the tear lines. When an envelope is separated from the series of connected envelopes, the tear line at the margin having the shortened glue line is severed so that the portion of the seal flap positioned above the top of the shortened glue line is released from the base layer at the margin down to the glue line. In this manner, the opening into the envelope compartment is expanded to facilitate ease of insertion and removal of the negative and the negative mounted on an aperture card.

13 Claims, 3 Drawing Sheets

CONTINUOUS FEED STORAGE ENVELOPES

BACKGROUND OF THE INVENTION

1. Field of the Invention

This invention relates to storage envelopes, and more particularly, to method and apparatus for storing cut negatives and negatives mounted on aperture or crop cards in serially connected envelopes constructed to facilitate ease of insertion and removal of the negatives and negatives mounted on cards.

2. Description of the Prior Art

In processing photographic film, it is the conventional practice to develop a roll of film to produce negatives from which photographs are printed. To facilitate the handling and storage of negatives, particularly in commercial photography, a roll of developed film is cut into individual frames of negatives or a strip of four to six negative frames, for example, connected together. The cut negatives or negative strips are inserted into storage envelopes. This is a very time consuming and expensive task if done manually. To make the process of cutting and bagging negatives more efficient, a number of automated devices have been developed to process negatives, as disclosed in U.S. Pat. Nos. 4,073,118; 4,115,981; 4,139,978; 4,154,046; and 4,217,743.

In a photographic process, a roll of developed film is cut into individual negatives which are stored in a continuous strip of print bags. The bags are separable from one another by perforations extending in a tear line at their lateral margins. Each bag is printed with information about the photograph including order number, photographer, exposure, print size and other related information.

U.S. Pat. Nos. 4,995,219 and 5,070,677 disclose automated devices for cutting individual negatives from a roll of developed film and inserting each negative into an envelope or bag that is serially connected to other bags. The connected bags are fed continuously from a supply by a tractor feed device through the cutting and bagging apparatus.

As disclosed in U.S. Pat. No. 4,995,219, the roll of developed film is rotatably mounted on a spool and fed vertically through a cutting device to sequentially separate each negative from the roll. Travelling through the apparatus in a horizontal direction perpendicular to the vertical feed from the roll of film is a continuous strip of envelopes separated from one another by tear lines. The strip of envelopes is driven by a tractor feed device engaging tractor feed holes located in separable strips extending along the longitudinal margins of the envelopes.

As each negative is cut from the roll, an envelope is advanced in the horizontal feed line to a position where the negative is positioned opposite an opening of an envelope. To insure complete insertion of a cut negative into the envelope, blowers positioned around the envelope create suction on the overlying layers to separate the layers and expand the opening. The negative is then directed under a blast of air through the opening into the compartment of the envelope.

Preferably, the negative is advanced completely into the envelope so that during subsequent handling it does not fall out of the envelope. Once the negatives are cut from the roll and inserted in the envelopes, the envelopes remain connected along the perforation lines for subsequent processing, including printing photographs from the negatives or mounting the negatives on the aperture cards for printing. Also once the negatives have been inserted in the envelopes, the envelopes can be separated from one another along the perforation lines.

When a negative is mounted on an aperture or a crop card for printing, the mounted negative is reinserted into the envelope which contains the necessary identifying information for the negative. A cut negative is easily inserted into the envelope because the longest dimension of the negative is substantially less than the width of the opening into the envelope. A conventional envelope for negative bagging has a width of 5 inches and is formed of flexible material. The base layer is conventionally paper and the top layer is acetate or glassine.

As with the serially connected envelopes disclosed in U.S. Pat. No. 4,995,219, the top layer of glassine is secured to the base layer of paper by glue lines which extend along a common lower longitudinal edge of the overlying material. Parallel lateral glue lines, spaced a preselected distance apart, extend on the base layer. The glassine layer adheres to the glue lines to form pockets of the envelopes. The pockets are sealed along three sides and are open on a fourth side opposite the upper longitudinal edge of each envelope. The tear lines formed by perforations extend in overlying relation with the transverse glue lines. The individual envelopes are easily separated from one another by severing the material along the tear lines formed by the perforations.

The transverse glue lines are conventionally about ¼ inch in width leaving an opening for the envelope between glue lines of about 4½ inches for an envelope having a total width of 5 inches. As indicated, a cut negative has a maximum dimension substantially less than 4½ inches so that it is easily inserted in the envelope. However, an aperture or crop card has a width of about 4 inches and a length of about 6⅜ inches. For an envelope opening of 4½ inches little clearance is available to receive a 4 inch wide aperture card. The aperture card is not easily inserted in the envelope.

Care must be taken to carefully insert an aperture card in the envelope to prevent tearing the glassine layer. Because of the close tolerances, insertion and removal of a carded negative in a storage envelope is a tedious process and must be done by hand. Because the insertion and removal of a carded negative may be performed a number of times during the photographic process, it is not adaptable to machine operation.

While it is known to store negatives and carded negatives in continuous feed storage envelopes, there is need for continuous feed storage envelopes operable in one mode to assure secure placement of cut negatives in the envelopes and operable in a second mode to facilitate the ease of insertion and removal of carded negatives without entailing the expense of increasing the size of the envelope to more efficiently accommodate the size of an aperture card.

SUMMARY OF THE INVENTION

A storage envelope includes a pair of overlying layers of flexible sheet material including a base layer and a seal flap. The base layer and seal flap each have a generally rectangular configuration. The base layer has a perimeter edge defined by an upper edge, a lower edge, a first side edge and a second side edge. The seal flap has a perimeter edge corresponding in configuration to the base layer perimeter edge. Means connects the seal flap perimeter edge to the base layer first and second side edges and the lower edge to form a pocket closed on three sides and open along the base layer upper edge. The means for connecting the seal flap to the base layer second side edge includes a line of glue adhering the seal flap to the base layer second side edge. The glue line has a preselected width extending upwardly from the base layer lower edge a preselected distance spaced from the base layer upper edge. The seal flap has a portion extending above the glue line on the base layer second side edge and releasable therefrom to form in a first mode the pocket closed on three sides and in a second mode, the pocket open across the base layer upper edge and downwardly on said base layer side edge to the glue line to increase the size of the opening into the pocket to enhance access thereto.

Further in accordance with the present invention, there is provided continuous storage envelopes including a base layer of flexible material having parallel longitudinally extending upper and lower edges of a preselected length. A top layer of flexible material corresponds in configuration with the base layer. The top layer is positioned in overlying relation with the base layer. The base layer is divided into a plurality of sections by lines of adhesive extending in spaced parallel relation between the upper and lower edges and along the lower edge. The lines of adhesive form lateral margins for individual envelopes. Each envelope includes a first lateral margin formed by adhesive extending from the lower edge to the upper edge and a second lateral margin formed by adhesive extending from the lower edge to a location spaced from the upper edge so that a portion of the second lateral margin below the upper edge is free of adhesive. The top layer engages the adhesive lines on the base layer to secure the top layer to the base layer to form a plurality of individual storage envelopes defined by the upper and lower edges and the first and second lateral margins with openings opposite the upper edges into pockets formed between the top and base layers. A series of perforations through the top and base layers in a line extending the distance between the upper and lower edges overlying the first and second lateral margins for each envelope to form tear lines separating the individual envelopes. The tear lines maintain the top and base layers connected between the upper and lower edges to close the envelopes on three sides and open on a fourth side opposite the top edge. The individual envelopes are separable from one another along the tear lines to automatically release the top layer from connection to the base layer above the second lateral margin where the base layer is free of adhesive to increase the size of the opening into the pocket.

Additionally, the present invention is directed to a method for storing articles in continuous feed envelopes comprising the steps of positioning a top layer of flexible material in overlying relation with a bottom layer of flexible material. The top layer adheres to the bottom layer along the lower edge of the overlying flexible materials. The top layer adheres to the bottom layer along spaced apart lateral glue lines to form a plurality of serially connected envelopes between the glue lines. One glue line extends in a continuous strip from an upper edge to the lower edge of each envelope. A second glue line extends from the lower edge to a point spaced from the upper edge of each envelope so that a portion of the envelope above the second glue line is free of glue. The top and bottom layers are perforated to form tear lines in overlying relation with the first and second glue lines. The tear lines extend the entire distance between the upper and lower edges to secure together the top and bottom layers and connect the envelopes to one another in a series. Each envelope connected in the series is closed along three sides to form a pocket open on a fourth side opposite the upper edge. An envelope is separated from the series along the tear lines. A portion of the top layer is released from connection to the bottom layer above the second glue line upon separation to expand the size of the opening into the pocket.

Accordingly, a principal object of the present invention to provide method and apparatus for storing cut negatives and cut negatives mounted on aperture cards in continuous feed storage envelopes that facilitate ease of insertion of both negatives and negatives mounted on aperture cards.

Another object of the present invention is to provide storage envelopes for negatives and negatives mounted on aperture cards where the envelopes are serially connected in one mode for rapid insertion of cut negatives and when individually separated in a second mode to facilitate ease of insertion of aperture cards.

A further object of the present invention is to provide storage envelopes serially connected for tractor feeding and bagging of cut negatives and converted upon separation for receiving negatives mounted on aperture cards.

An additional object of the present invention is to provide a storage envelope automatically converted from a negative envelope to an aperture card envelope in the photographic process.

These and other objects of the present invention will be more completely disclosed and described in the following specification, accompanying drawings, and the appended claims.

DESCRIPTION OF THE PREFERRED EMBODIMENTS

Figure 1:
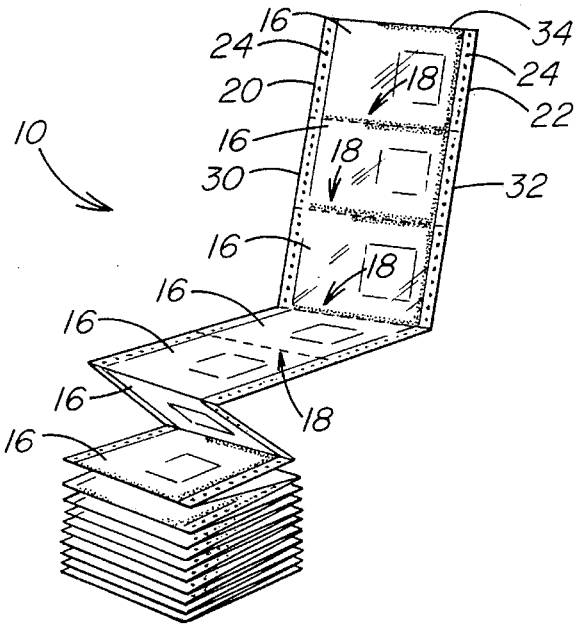
FIG. 1 is an isometric view of continuous feed storage envelopes for cut negatives and negatives mounted on aperture cards in accordance with the present invention.
Figure 3:
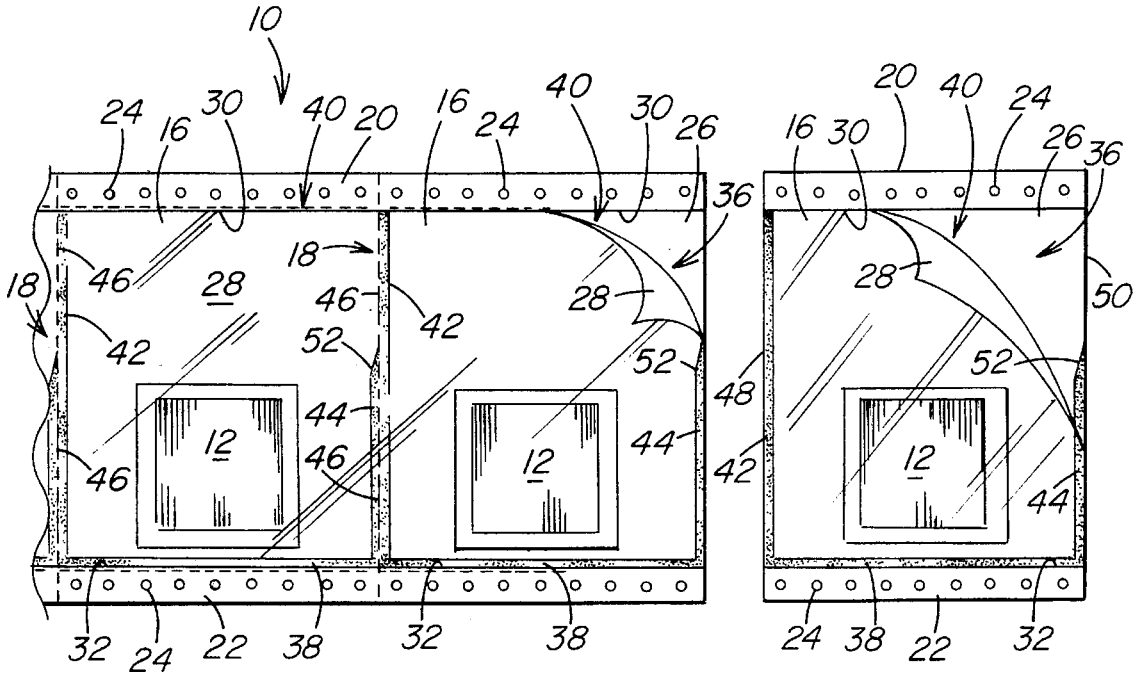
FIG. 3 is a view similar to FIG. 2, illustrating one envelope separated from the serially connected envelopes with the opening automatically expanded upon separation from the other envelopes.
Figure 2:
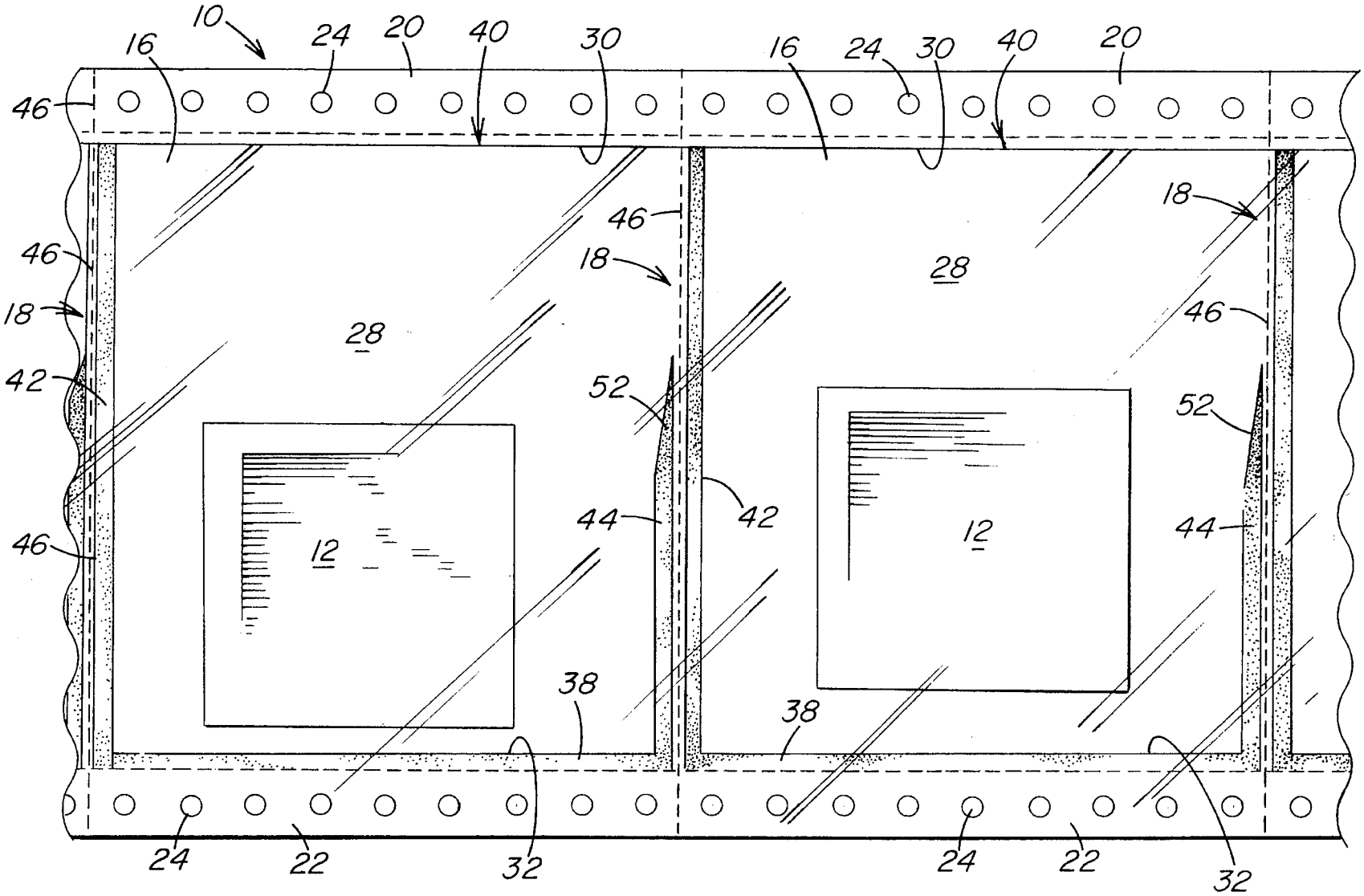
FIG. 2 is an enlarged fragmentary top plan view of the serially connected storage envelopes, illustrating cut negatives inserted in pockets of the envelopes.
Figure 6:
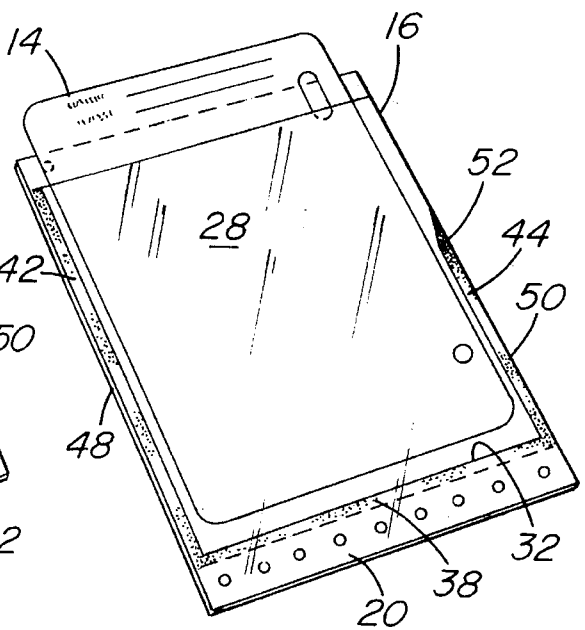
FIG. 6 is a further view similar to FIGS. 4 and 5, illustrating the carded negative positioned in the envelope with the top flap returned to a position overlying the base layer of the envelope.
Figure 5:
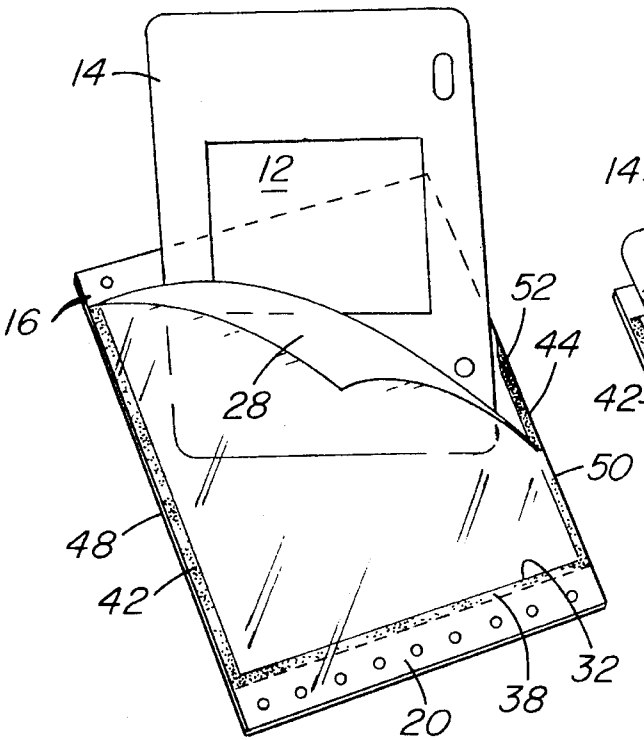
FIG. 5 is a view similar to FIG. 4, illustrating a portion of the top layer of the envelope displaced at the right glue line to expand the opening for ease of insertion of the carded negative.
Figure 4:
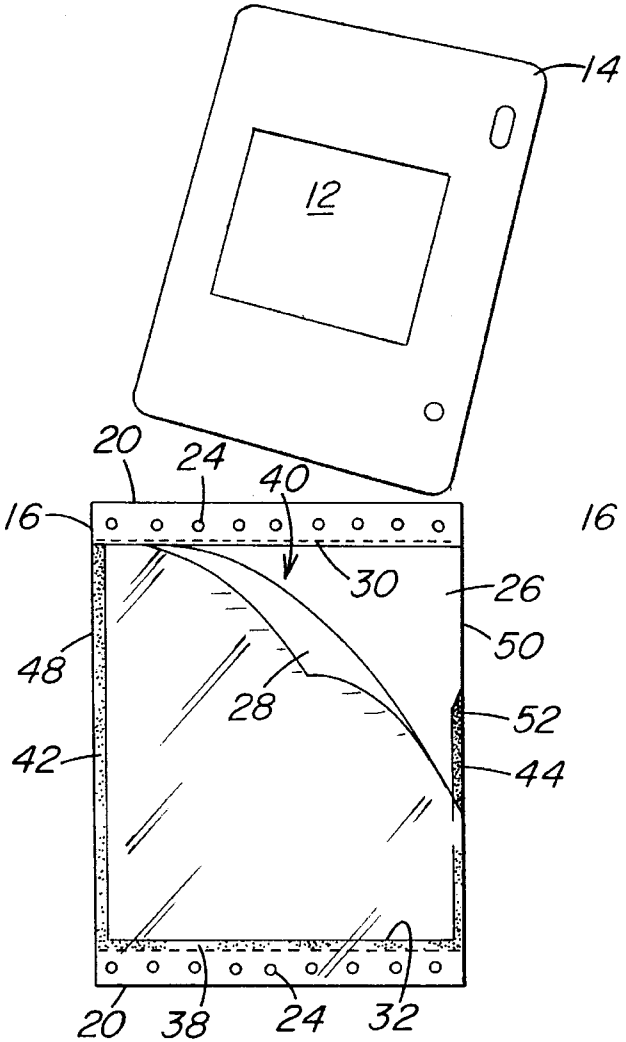
FIG. 4 is an isometric view of an individual storage envelope, illustrating the opening expanded for ease of insertion of a carded negative.

Referring to the drawings and particularly to FIGS. 1–3, there is illustrated a series of continuous feed storage envelopes generally designated by the numeral 10 for the storage and handling of individual negatives 12, as illustrated in FIG. 3, which are cut from a roll of developed film and negatives 12 mounted on aperture cards 14, as illustrated in FIGS. 4–6. The series or strip 10 of storage envelopes is manufactured from a variety of materials, as known in the art, including paper, glassine, acetate and other flexible sheet material having a material strength adequate to protect the negatives and aperture cards during storage and handling in the photographic process by the photographer and at the photographic laboratory.

The series 10 of continuous feed storage bags are constructed to form a plurality of individual envelopes or bags 16 connected to one another in a continuous strip. The envelopes 16 are separated from one another by tear lines 18 formed by perforations which allow individual envelopes 16, as illustrated in FIG. 3, to be separated from one another once the negatives 12 have been cut and placed in the envelopes 16. As will be explained later in greater detail, when an individual envelope 16 is separated from the strip 10, the envelope 16 is automatically converted to include an opening of increased size to facilitate ease of insertion and removal of the negative mounted aperture card 14 as shown in FIGS. 4–6.

The series 10 of continuous feed storage envelopes includes strips 20 and 22 of tractor feed holes 24 connected by perforations to the opposite longitudinal margins of the overlying layers 26 and 28. The tractor feed holes 24 are engaged by sprockets of a tractor feed device of a machine (not shown) designed to cut and insert automatically the individual photographic film negatives 12 in each individual envelope 16. A machine suitable for using the series 10 of continuous feed storage envelope of the present invention is illustrated and disclosed in the U.S. Pat. No. 4,995,219 which is incorporated herein by reference.

The series 10 of envelopes is fed by the machine in a direction of travel at right angles to the direction of travel of the negatives conveyed from a roll mounted on a spool of the cutting and bagging machine. The roll of film is fed from the spool through a cutter above the envelopes. Each negative frame is cut from the roll and directed by a blast of air through the opening between the overlying layers of material forming the envelopes. The layers are sequentially separated by a vacuum to hold the envelopes open as the negative is inserted. Once the negative is received within the envelope, the vacuum is released and the envelope strip 10 is incrementally advanced to position the next individual envelope 16 in underlying relation with the cutter to receive the next negative 12 cut from the roll. All the negatives are individually cut and inserted into the envelopes 16 which remain connected in the series 10.

Once all of the negatives are cut and stored in envelopes 16, the connected envelopes 16 are then transported for subsequent processing. The individual envelopes 16 may be separated from the series connection and the negatives 12 removed from the envelopes 16. Photographs may be printed from the negatives. The negatives may also be mounted on aperture cards and then reinserted in the envelopes for storage prior to printing the negatives.

As illustrated in FIGS. 2 and 3, the envelopes 16 connected in the continuous series or strip 10 are formed of two layers of flexible sheet material, the base layer 26 and the top layer 28. The top layer 28 forms the seal flap for each envelope 16. The base layer 26 is preferably fabricated of paper, and the top layer is fabricated of glassine, but both layers 26 and 28 may be fabricated of glassine or paper. The layers 26 and 28 are continuous in length for the entire series 10 of connected envelopes 16 as shown in FIG. 1.

The layers are substantially rectangular in shape as defined by the longitudinally extending strips 20 and 22 that include the tractor feed holes 24. The strips 20 and 22 are separable from the individual envelopes 16 by perforations which define an upper edge 30 and a lower edge 32 of each envelope. The strips 20 and 22 containing the tractor feed holes 24 are separable from the body of each envelope 16.

The ends of the series 10 of envelopes include transverse edges one of which is edge 34 shown in FIG. 1. The base layer 26 and top layer 28 have an identical configuration and dimensions and are secured to one another by adhesive glue lines. The glue lines are applied in a preselected gluing paper to divide the overlying layers 26 and 28 into individual envelopes each having a pocket or compartment generally designated by the numeral 36 as shown in FIGS. 3–5. When the envelopes are connected in the series 10, they are each closed or sealed along three sides and open along a fourth side opposite the upper edge 30 of each envelope 16.

As shown in detail in FIGS. 2 and 3, the top layer 28 of glassine material is secured by a plurality of glue lines to the base layer 26 of paper material. A plurality of parallel spaced transverse glue lines between the upper edge 30 and the lower edge 32 secure the top layer 28 to the base layer 26 and serve to divide the layers into the individual envelopes 16. A longitudinal glue line 38 extends the full length of the overlying layers 26 and 28 at the lower edge 32 to form a bottom seal for each envelope 16. The longitudinal edge of each envelope opposite the upper edge 30 is free of glue to form an opening generally designated by the numeral 40 into each envelope. With this arrangement, the top layer 28 is separable from the base layer 26 at the upper edge 30.

Glue lines 42 and 44 are applied between the base and top layers 26 and 28 to form a pair of lateral margins for each envelope 16. As seen in FIGS. 2 and 3, the glue line 42 forms the left margin of each envelope, and the glue line 44 forms the right margin of each envelope. As will be explained later in greater detail, the glue line 42 extends entirely the full transverse distance between the upper edge 30 and the lower edge 32 of each envelope 16. In comparison, the right marginal glue line 44 extends upwardly from the lower edge 32 to a location on the right margin of each envelope spaced from the upper edge 30. With this arrangement a portion of the overlying layers 26 and 28 at the right margin of each envelope 16 is free of glue.

With the top layer 28 secured by the glue lines 38, 42 and 44 to the base layer 26, a plurality of individual storage envelopes 16 are formed the complete length of the overlying layers 26 and 28. Each envelope 16 is defined by the upper and lower edges 30 and 32, the lateral margins formed by the glue lines 42 and 44, and a bottom seal formed by the glue line 38. The remaining portions of the overlying layers are separable so as to form the compartment 36 for receiving articles between the overlying layers 26 and 28.

The envelopes 16 connected in the continuous strip 10 are further divided from one another by perforations 46 that extend transversely in spaced parallel relation between the upper and lower edges 30 and 32 in overlying relation with the marginal glue lines 42 and 44. The perforations 46 form the tear lines 18 which extend on the marginal glue lines 42 and 44.

The tear lines 18 maintain the overlying layers 26 and 28 connected in the strip 10. The tear line 18 that extends along the right margin of each envelope over the abbreviated or shortened glue line 44 secures the layers 26 and 28 to each other. The layers 26 and 28 are free of glue at the right margin between the top of the abbreviated glue line 44 and the envelope upper edge 30.

As long as the tear line 18 at the right margin of each envelope remains intact, i.e. before an envelope 16 is separated from the strip 10, the entire right margin of each envelope remains sealed the complete length between the upper and lower edges 30 and 32. Thus, with the envelopes connected in the strip 10, each envelope 16 is sealed at the left and right margins and along the bottom of each envelope opposite the lower edge 32. The overlying layers 26 and 28 at the upper edge 30 are not connected so as to form the opening 40 for receiving the individual cut negatives 12.

When the strip 10 of continuous feed storage envelopes are fed through the cutting and bagging machine, the connected envelopes are progressively advanced into underlying relation with the cutter. Suction forces are applied to the overlying areas to separate them to assure that the cut negative under a blast of air is driven into the compartment 36 of each envelope 16. As seen in FIG. 3, the negatives 12 are preferably advanced to the lower portion of the compartments 36 to securely retain them in each envelope 16. When the negatives 12 are introduced into the connected strip 10 of envelopes, only the side opposite the upper edge 30 is open. The remaining three sides of each envelope 16 are sealed, including the right margin of each envelope where the abbreviated glue line 44 is located because the portion of the envelope above the glue line 44 is closed by the tear line 18.

After the negatives 12 are cut from the roll of developed film and introduced into the connected envelopes 16, the connected envelopes are then transported to the next location for processing. If desired, the envelopes may remain connected in the strip 10 or separated from one another along the tear lines 18. With the envelopes remaining connected, the negatives 12 can be removed for printing photographs. The photograph and matching negative are returned to the same envelope which bears the desired data on the exterior of the envelope, for example, identification of the subject, the photographer, date, job number and the like. Thereafter, the connected bags containing the negative and matching print are transported for further processing.

At a desired point in the processing, individual envelopes 16 are separated from the strip 10 of connected envelopes by severing the tear lines 18. As seen in FIG. 3, when a tear line 18 is severed between adjacent envelopes 16, the marginal glue lines 42 and 44 remain in place. Because the left marginal glue line 42 extends the full length between the envelope upper and lower edges 30 and 32, the left margin remains sealed. However, when an envelope is separated on the tear line 18 at the right margin, the top layer 28 is released from connection to the base layer 26. This permits the top layer 28 to be separated from the base layer 26 not only along the upper edge 30, but along the right margin down to the top of the abbreviated marginal glue line 44. Consequently access to the compartment 36 is substantially improved.

The seal flap 28 automatically opens at the right margin when an envelope 16 is separated from the strip 10. In other words, the opening 40 into a separated envelope 16 expands in size because the portion of the right seal flap margin above the abbreviated glue line 44 is released when the tear line 18 is severed. Expanding the opening 40 down the right margin makes it easier to insert and remove articles from the compartment 36. This is particularly advantageous when a negative 12 is removed for mounting on an aperture card 14 as illustrated in FIG. 4.

The aperture or crop card 14 shown in FIG. 4 is conventional in design and includes an opening of a preselected dimension over which the film negative 12 is securely positioned on the card 14. Aperture cards are provided with openings of selected dimensions so that a desired content of the film negative is exposed for printing. An aperture card having an opening less than the dimensions of the negative eliminates a marginal portion of the negative from exposure. In this manner, the composition of the photograph printed from a mounted negative is customized.

A conventional crop card has, for example, a width of 4 inches and a length of 6⅜ inches. In comparison, a conventional storage envelope has a width of 5 inches and a length of 6½ inches. Thus, for a conventional storage envelope an aperture card extends about 1¼ inches from the open end of the envelope.

For a conventional storage envelope having a width of 5 inches, the width of each marginal glue line is ¼ inch. Therefore, the width of the pocket of a conventional storage envelope between the marginal glue lines is 4½ inches. With a conventional aperture card of 4 inches, this allows only ½ inch marginal clearance for insertion and removal of the aperture card in the envelope. Consequently, it is difficult to efficiently insert and remove an aperture card from a conventional envelope. Because the glassine top layer of a conventional storage envelope is very thin, it is not uncommon to tear the layer upon insertion of an aperture card in the envelope.

With the present invention of automatically releasing a portion of the seal flap 28 from the base layer 26 at the right margin above the glue line 44, a greater portion of the seal flap 28 is free to move away from the base layer 26. This makes it easier to insert the aperture card 14 in the envelope 16 and avoids tearing the seal flap 28.

FIG. 4 illustrates the portion of the seal flap or envelope top layer 28 released from the base layer 26 when the envelope 16 is separated from the strip 10. Separating an envelope 16 from the strip 10 forms lateral edges 48 and 50 on each individual envelope 16. The top layer 28 is disconnected from the base layer 26 the full width of the upper edge 30 and initially along the lateral edge 50 between the upper edge 30 and the top of the abbreviated marginal glue line 44. Also, as shown in FIG. 4, the opening 40 in the envelope 16 can be opened even wider by separating a portion of the seal flap 28 from the marginal glue line 44.

Preferably, the width of the envelope 16 between the lateral margins 48 and 50 is 4½ inches or ½ inch less than the width of a conventional storage envelope, which is 5 inches. The marginal glue lines 42 and 44 have a width in one embodiment of ⅛ inch as opposed to a width of ¼ inch for the glue lines of a conventional storage envelope. Therefore, for the envelope 16, the width between the marginal glue lines 42 and 44 is 4¼ inches which is ¼ inch less than the width of a conventional storage envelope. However, with the present invention, the seal flap 28 is released along a portion of the lateral edge 50 to enlarge the opening 40 into the compartment 36. This allows faster handling of a negative and a negative mounted aperture card in the envelope.

It should also be understood with the present invention that the width of the glue lines 42 and 44 may be less than ⅛ inch. In other examples, based on the type of adhesive used, the glue lines 42 and 44 are 1/16 inch and 1/32 inch in width. Furthermore, the adhesive may be applied in any preselected gluing pattern which is not confined to a continuous line. The adhesive may be applied intermittently in a pattern similar to the perforations 46. Preferably, the area of the base layer 26 covered by adhesive does not extend 3% of the surface area of the base layer 26.

The present invention also includes the feature of the abbreviated marginal glue line 50 having a tapered upper end portion 52 as illustrated in FIGS. 2–6. At the upper end portion 52, the glue line gradually expands in width from a point at the extreme end of the glue line downwardly to where the width is uniform to the lower edge 32. For the short length of the tapered portion 52 of the marginal glue line 44 a minimal amount of adhesive secures the seal flap 28 to the base layer 26 at the lateral edge 50.

With a point of minimal adhesive connection of the seal flap 28 to the base layer 26, the seal flap 28 is easily separated from the glue line 44 to expand the opening 40 even further. This can be accomplished by a pull force on the seal flap 28 which would otherwise tend to tear the glassine material before it would release from glue line 44. However, with the tapered portion 52 of the glue line 44, the seal flap 28 upon pulling readily releases without tearing. The minimal glue connection holds the seal flap 28 in place, but facilitates easy separation without tearing the material. This permits the opening 40 into the compartment 36 to be enlarged to make it easier to insert and remove an aperture card. Once the aperture card is inserted in the envelope 16 as shown in FIG. 6, the seal flap is released to overlie the aperture card and the base layer 26 at the lateral edge 50 even though a portion of the seal flap at the lateral edge 50 is disengaged from the base layer 26.

The provision of the tapered upper end portion 52 of the marginal glue line 44 also serves as a raised edge on the base layer 26 to receive the edge of the aperture card and direct it downwardly into the envelope compartment 36. Thus, with the present invention of utilizing marginal glue lines 42 and 44 of reduced width and expanding the opening 40 by releasing a portion of the seal flap from one of the lateral margins, the overall width of an envelope can be reduced requiring less material to be used in the manufacture. Even though the traverse opening is 4¼ inches rather than 4½ inches, it is easier to insert and remove an aperture card because a portion of the seal flap at the lateral edge is free to move so that the size of the opening into the envelope compartment 36 is expanded.

The expanded opening into the envelope 36 is automatically formed upon separation of the envelope from the continuous strip 10. Prior to separation, the seal flap 28 at the lateral edge 50 remains connected to the base layer 26 to assure that the negative is securely retained in the envelope. Even when a portion of the seal flap 28 is released at a lateral margin, a substantial portion of the seal flap edge remains adhered to the base layer 26 to assure that a negative 12 remains covered by the layers of the envelope. For example, the abbreviated marginal glue line 44 has a length of 3½ inches which is sufficient to maintain a negative fully protected within the compartment 36.

In most applications, a negative is inserted in the envelope 16 before it is separated from the strip 10 so that the seal flap 28 remains connected to the base layer 26 along the entire length of the lateral edge 50. Then once an envelope 16 is separated from the continuous strip 10, a portion of the seal flap 28 is released at the lateral edge. This makes it easier to remove the negative 12 from the envelope 16 for mounting on an aperture card 14. Then when it is desired to reinsert the negative 12 mounted on the aperture card 14, the opening 40 into the compartment 36 is enlarged by separating a portion of the seal flap 28 from the tapered glue line 44.

With the present invention a versatile storage envelope 16 is provided to securely retain cut negatives in bags that increases the efficiency of removing and inserting the cut negatives and mounting and inserting cut negatives on aperture cards. This efficiency is obtained while at the same time decreasing the amount of material used in the construction of the envelope 16.

According to the provisions of the patent statutes, I have explained the principal, preferred construction, and mode of operation of my invention and have illustrated and described what I now consider to represent its best embodiments. However, it should be understood that, within the scope of the appended claims, the invention may be practiced otherwise than as specifically illustrated and described.

I claim:

1. Continuous storage envelopes comprising, a plurality of storage envelopes connected to each other in end to end relation to form a series of connected envelopes where each storage envelope includes a pair of overlying layers of flexible sheet material including a base layer and a seal flap, said base layer and said seal flap each having a generally rectangular configuration, said base layer having a perimeter edge defined by a top edge, a bottom edge, a first side edge, and a second side edge, said first and second side edges of each storage envelope being releasably connected to said second and first side edges respectively of adjacent envelopes, said seal flap having a perimeter edge corresponding in configuration to said base layer perimeter edge, said seal flap perimeter edge connected to said base layer first side edge by a line of glue extending from said top edge to said bottom edge at said first side edge, said seal flap perimeter edge connected to said base layer first and second side edges and said bottom edge to form a pocket closed on three sides and open along said base layer top edge, a line of glue for adhering said seal flap to said base layer at said second side edge, said glue line having a selected width extending upwardly from said base layer bottom edge a preselected distance spaced from said base layer top edge so that a portion of said base layer second side edge adjacent to said base layer top edge is free of glue, a series of perforations extending through said overlying layers to form a tear line extending above said glue line for releasably connecting said seal flap to said base layer at said second side edge above said glue line to form said pocket, said pocket closed on three sides in a first mode of operation, and said seal flap separates from said base layer in a second mode of operation along said tear line above said glue line on said second side edge to form said pocket open across said base layer top edge and downwardly on said base layer second side edge to said glue line to increase the size of the opening into said pocket to enhance access thereto.

2. Continuous storage envelopes as set forth in claim 1 which includes, a strip of tractor feed holes extending the length of said base layer perimeter edge at said top edge and said bottom edge, and means extending on said top edge and said bottom edge for separating said strip therefrom.

3. Continuous storage envelopes as set forth in claim 1 in which, said tear line extending from said base layer top edge downwardly to said glue line to releasably connect said seal flap to said base layer at said second side edge, and seal flap released from said layer upon severing of said tear line to allow displacement of said seal flap from said base layer along the entire length of said top edge and downwardly on said second side edge to said glue line to expand the size of the opening into said pocket.

4. Continuous storage envelopes as set forth in claim 3 in which, said pocket is sealed in said first mode of operation on three sides along said first and second side edges and said bottom edge and open along said top edge, said pocket sealed in said second mode of operation upon severing of said tear line on said first side edge and said bottom edge and open along said top edge and downwardly therefrom a preselected distance on said second side edge to said glue line, and said opening into said envelope being expanded in size upon connection of said pocket from said first mode of operation to said second mode of operation.

5. Continuous storage envelopes comprising, a base layer of flexible material having parallel longitudinally extending upper and lower edges of a preselected length, a top layer of flexible material corresponding in configuration with said base layer, said top layer positioned in overlying relation with said base layer, said base layer being divided into a plurality of sections by lines of adhesive extending in spaced parallel relation between said upper and lower edges and along said lower edge, said lines of adhesive forming lateral margins for individual envelopes, each envelope including a first lateral margin formed by adhesive extending from said lower edge to said upper edge and a second lateral margin formed by adhesive extending from said lower edge to a location spaced from said upper edge so that a portion of said second lateral margin below said upper edge is free of adhesive, said top layer engaging said adhesive lines on said base layer to secure said top layer to said base layer to form a plurality of individual storage envelopes defined by said upper and lower edges and said first and second lateral margins with openings opposite said upper edges into pockets formed between said top and base layers, a series of perforations through said top and base layers in a line extending the distance between said upper and lower edges overlying said first and second lateral margins for each envelope to form tear lines separating said individual envelopes, said tear lines maintaining said top and base layers connected between said upper and lower edges to close said envelopes on three sides and open on a fourth side opposite said top edge, said tear line connecting said top layer to said base layer above said adhesive line at said second lateral margin to maintain said envelopes closed on three sides, and said top layer being separable from said base layer along said tear line above said adhesive line at said second lateral margin when said individual envelopes are separated from one another along said tear lines to increase the size of said opening into said pocket.

6. Continuous storage envelopes as set forth in claim 5 which includes, a strip of tractor feed holes extending the length of said upper and lower edges, and means extending on said upper and lower edges for separating said strip therefrom.

7. Continuous storage envelopes as set forth in claim 5 in which, said adhesive lines of each storage envelope extend from said upper edge downwardly on said first lateral margin to said lower edge, along said lower edge to said second lateral margin, and upwardly on said second lateral margin to a location spaced below said upper edge.

8. Continuous storage envelopes as set forth in claim 7 which includes, said top layer being free of an adhesive connection to said base layer along said upper edge and downwardly therefrom a preselected distance on said second lateral margin to expand the separation between said top and base layers upon severing of said tear line above said adhesive line at said second lateral margin for increasing the size of said opening into said pocket.

9. Continuous storage envelopes as set forth in claim 5 which includes, said top layer being automatically released from connection to said base layer at said second lateral margin above said line of adhesive upon separation of said envelopes one from another to increase the size of said opening into said envelope pocket.

10. Continuous storage envelope as set forth in claim 5 in which, said individual envelopes are connected in a continuous series by said tear lines, and said individual envelopes when separated along said tear lines from said series being converted from envelopes open only along said upper edge to envelopes open along said upper edge and partially along one of said lateral margins.

11. Continuous storage envelopes as set forth in claim 5 in which, said adhesive lines have a preselected width.

12. A storage envelope comprising, a pair of overlying layers of flexible sheet material including a base layer and a seal flap, said base layer and said seal flap each having a generally rectangular configuration, said base layer having a perimeter edge defined by a top edge, a bottom edge, a first side edge, and a second side edge, said seal flap having a perimeter edge corresponding in configuration to said base layer perimeter edge, means for connecting said seal flap perimeter edge to said base layer first and second side edges and said bottom edge to form a pocket closed on three sides and open along said base layer top edge, said means for connecting said seal flap to said base layer second side edge including a line of glue for adhering said seal flap to said base layer second side edge, said glue line having a selected width extending upwardly from said base layer bottom edge a preselected distance spaced from said base layer top edge, said glue line at said second side edge includes a tapered upper end portion formed by starting at a point spaced a selected distance below said top edge and progressively increasing in width as glue line extends downwardly at said second side edge to a point where said glue line has a uniform width, and said seal flap having a portion extending above said glue line on said base layer second side edge and releasable therefrom to form in a first mode said pocket closed on three sides and in a second mode said pocket open across said base layer top edge and downwardly on said base layer second side edge to said glue line to increase the size of the opening into said pocket to enhance access thereto.

13. Continuous storage envelopes comprising, a base layer of flexible material having parallel longitudinally extending upper and lower edges of a preselected length, a top layer of flexible material corresponding in configuration with said base layer, said top layer positioned in overlying relation with said base layer, said base layer being divided into a plurality of sections by lines of adhesive extending in spaced parallel relation between said upper and lower edges and along said lower edge, said lines of adhesive forming lateral margins for individual envelopes, each envelope including a first lateral margin formed by adhesive extending from said lower edge to said upper edge and a second lateral margin formed by adhesive extending from said lower edge to a location spaced from said upper edge so that a portion of said second lateral margin below said upper edge is free of adhesive, said top layer engaging said adhesive lines on said base layer to secure said top layer to said base layer to form a plurality of individual storage envelopes defined by said upper and lower edges and said first and second lateral margins with openings opposite said upper edges into pockets formed between said top and base layers, said adhesive line at said second lateral margin having a tapered upper end portion spaced a preselected distance from said upper edge to facilitate release of said top layer from adhesive connection to said base layer at said second lateral margin, said tapered upper end portion extending from a point of application of adhesive downwardly in a line progressively expanding in width to a fixed width of adhesive extending to said bottom edge, a series of perforations through said top and base layers in a line extending the distance between said upper and lower edges overlying said first and second lateral margins for each envelope to form tear lines separating said individual envelopes, said tear lines maintaining said top and base layers connected between said upper and lower edges to close said envelopes on three sides and open on a fourth side opposite said top edge, and said individual envelopes being separable from one another along said tear lines to automatically release said top layer from connection to said base layer above said second lateral margin where said base layer is free of adhesive to increase the size of said opening into said pocket.

* * * * *